US010607760B2

(12) United States Patent
Boldl et al.

(10) Patent No.: US 10,607,760 B2
(45) Date of Patent: Mar. 31, 2020

(54) COIL BODY

(71) Applicant: SUMIDA Components & Modules GmbH, Obernzell (DE)

(72) Inventors: Johann Boldl, Hauzenberg (DE); Rainer Pilsl, Obernzell (DE)

(73) Assignee: SUMIDA Components & Modules GmbH, Obernzell (DE)

( * ) Notice: Subject to any disclaimer, the term of this patent is extended or adjusted under 35 U.S.C. 154(b) by 680 days.

(21) Appl. No.: 15/210,033

(22) Filed: Jul. 14, 2016

(65) Prior Publication Data

US 2017/0018347 A1 Jan. 19, 2017

(30) Foreign Application Priority Data

Jul. 17, 2015 (DE) ..... 10 2015 213 499

(51) Int. Cl.
*H01F 27/04* (2006.01)
*H01F 5/00* (2006.01)
(Continued)

(52) U.S. Cl.
CPC ..... *H01F 27/04* (2013.01); *H01F 5/04* (2013.01); *H01F 27/266* (2013.01);
(Continued)

(58) Field of Classification Search
CPC ..... H01F 2005/046; H01F 2005/043; H01F 27/04
See application file for complete search history.

(56) References Cited

U.S. PATENT DOCUMENTS 3,477,051 A * 11/1969 Clark ..... C25D 21/10 29/606
3,483,497 A * 12/1969 Clark ..... H01F 19/08 29/606
(Continued)

FOREIGN PATENT DOCUMENTS

DE 2047901 A1 * 4/1972 ..... H01F 5/04
DE 23 28 227 12/1974
(Continued)

OTHER PUBLICATIONS

Report or action dated Feb. 20, 2017 in corresponding European Application No. 16179542.2.
(Continued)

*Primary Examiner* — Elvin G Enad
*Assistant Examiner* — Malcolm Barnes
(74) *Attorney, Agent, or Firm* — Fattibene and Fattibene LLC; Paul A. Fattibene

(57) ABSTRACT

A coil body with a hollow housing body is provided that has on a first side an opening for the intake of a coil into the housing body along an inserting direction and a housing wall that extends between the first side of the housing body and a second side that is located opposite. The coil body further comprises multiple electric contacts and a plurality of guiding grooves that are disposed along the housing wall and that are each formed for guiding of a connection wire in order to connect a coil, which has been absorbed by the housing body, to the contacts. The contacts are thereby disposed on the second side on the housing body.

6 Claims, 3 Drawing Sheets

(51) Int. Cl.

| | |
|---|---|
| ***H01F 27/28*** | (2006.01) |
| ***H01F 5/04*** | (2006.01) |
| ***H01F 27/26*** | (2006.01) |
| ***H01F 27/29*** | (2006.01) |
| ***H01F 27/32*** | (2006.01) |

(52) U.S. Cl.
CPC ..... *H01F 27/2828* (2013.01); *H01F 27/292* (2013.01); *H01F 27/323* (2013.01); *H01F 2005/043* (2013.01); *H01F 2005/046* (2013.01); *H01F 2027/297* (2013.01)

(56) References Cited

U.S. PATENT DOCUMENTS

| | | | | |
|---|---|---|---|---|
| 4,617,543 | A * | 10/1986 | Akachi et al. | H01F 27/29 |
| 7,515,026 | B1 | 4/2009 | Liu et al. | 336/192 |
| 2005/0007231 | A1* | 1/2005 | Kim et al. | H01F 27/325 |
| 2006/0050485 | A1* | 3/2006 | Chin | H01F 27/22 |
| 2011/0187485 | A1 | 8/2011 | Toyoda et al. | 336/192 |
| 2011/0221562 | A1 | 9/2011 | Tsai et al. | 336/221 |
| 2012/0242444 | A1 | 9/2012 | Tseng et al. | 336/170 |
| 2013/0321114 | A1 | 12/2013 | Lin et al. | 336/192 |
| 2014/0001976 | A1* | 1/2014 | Park | H01F 5/04 315/276 |
| 2014/0002230 | A1 | 1/2014 | Hsiao et al. | 336/212 |
| 2014/0306785 | A1 | 10/2014 | Maier et al. | 336/90 |

FOREIGN PATENT DOCUMENTS

| | | | | |
|---|---|---|---|---|
| DE | 28 25 152 | | 12/1979 | |
| DE | 2825152 | B1 * | 12/1979 | H01F 17/062 |
| DE | 3138936 | C1 * | 2/1983 | H01F 5/04 |
| DE | 3220002 | A1 * | 12/1983 | H01F 5/04 |
| EP | 2061045 | A2 * | 5/2009 | H01F 17/062 |
| JP | S60 76113 | | 4/1985 | |
| JP | H0624169 | B2 * | 3/1994 | H01F 5/04 |
| JP | 2002 208520 | | 7/2002 | |
| JP | 2006156702 | A * | 6/2006 | H01F 27/323 |
| JP | 2009 272434 | | 11/2009 | |
| JP | 2009272434 | A * | 11/2009 | H01F 17/06 |

OTHER PUBLICATIONS

Report or action dated Dec. 16, 2016 in corresponding European Application No. 16179542.2.
Report or action dated Mar. 24, 2016 in corresponding German Application No. 10 2015 213 499.7.

* cited by examiner

COIL BODY

FIELD OF THE INVENTION

The present invention relates to a coil body for inductive components such as transformers and inductors.

BACKGROUND OF THE INVENTION

Inductive components such as inductors and transformers are used in many fields of technology, for example in the automotive industry. There, conductor plate components such as power electronics, in which so-called momentum transformers or pulse transformers are used to control the gate of an electronic switching element, are used in automobile electronics. A "gate drive transformer" is a pulse transformer that controls the timing of power MOSFETs or IGBTs in switching power supplies ("Switch-mode-power-supply" or SMPS) as shown for example in the publication "A guide to designing gate drive transformers", power electronics technology, 2007: 32 to 36, by Patrick Scoggins.

Gate-drive transformers usually have a coil that is supported by a coil body that may be formed both as surface-mountable (SMD) components or as through-hole components. In this, safety standards that require, inter alia, compliance with insulation and creepage paths shall be complied with just as for general electric and electronic components. The requirements for creepage and insulation paths are normally complied with by ensuring the coil bodies to be cast with a casting compound in a housing.

During the equipment of conductor plates with inductive components, reflow soldering processes are implemented to connect, inter alia, inductive components with conductor plates electrically and mechanically. In this, high temperatures arise during the soldering processes so that a component is frequently exposed to temperature fluctuations of 100° C. or more during the manufacturing process. Due to the varying expansion coefficients among the different materials in inductive components, for example among the casting compound, the coil body, the ferrite core and the winding, there will also be different thermal expansions as a consequence that lead to tensions in the material and ultimately to breakage. In many cases, for example the casting compound breaks, whereby the creepage and air paths of an inductive component are strongly reduced so that the standard requirements according to IEC/UL etc. may no longer be complied with.

A component may be exposed to further temperature fluctuations during operation. For example automobile electronics in close proximity to the engine are also exposed to high temperature fluctuations of −40° C. to +155° C. or more during operation. Furthermore, electric and electronic components of automobile electronics are subject to high mechanical stresses due to shock effects.

Based on the situation explained above, a coil body for an inductive component in which the disadvantages described above are eliminated shall be provided.

SUMMARY OF THE INVENTION

The present invention provides a solution of the above-mentioned problem in different aspects. Herein, it is suggested to replace the casting compound by accordingly designed structural measures. According to the invention, this is achieved by prolonging the creepage paths in a way that the casting compound is no longer needed.

In a first aspect of the invention, a coil body with a hollow housing body is provided, which has an opening on a first side to insert a coil in the housing body along an inserting direction and a housing wall that extends between a first side of the housing body and an opposite second side. Further, the housing body has multiple electric contacts and a plurality of guiding grooves that extend along the housing wall and that are formed respectively to guide a connection wire in order to connect a coil absorbed by the coil body with the contacts that are disposed on the second side of the housing.

In a descriptive embodiment of the first aspect, the coil body further has slits that are formed on the edge of the opening and that are disposed on the opening in a circumferential direction so that a defined throughput into the housing body and/or out of the housing body is provided for each guiding groove. These slits are aligned in particular in the area of the opening with the prolongation of creepage paths.

In a further descriptive embodiment of the first aspect, at least one guiding groove extends completely along the housing wall.

In a further descriptive embodiment of the first aspect, the housing body is formed to absorb a torus-shaped coil.

In a further descriptive embodiment of the first aspect, the guiding grooves are formed by fins that protrude from the housing wall and that are arranged in parallel along the inserting direction. In this way, guiding grooves for efficient prolongation of the creepage path are provided in a simple manner.

In a more advantageous embodiment herein, respectively two fins form a guiding groove and the fins of respectively one guiding groove are all arranged at a distance from the fins of the other guiding grooves so that respectively one insulation groove is formed between two guiding grooves. This provides another more advantageous prolongation of creepage paths between the connection wires that are routed in the guiding grooves.

In another more advantageous embodiment herein, the insulation grooves have different depths. In some examples herein, the dielectric strength is increased further so that the insulation grooves are provided with a greater depth respectively between the guiding grooves into which the connection wires that are on a higher potential are inserted. Consequently, a more compact design of the coil body may be achieved.

In a second aspect of the invention, a coil body is provided with two row of contacts, which are each equipped with a plurality of electric contacts, that are formed on two sides of the coil body that are located opposite to each other. Each row of contacts thereby has guiding grooves that are formed on a surface of the row of contacts and that are each designed to guide a connection wire in order to connect a coil disposed on the coil body to at least one of the contacts of the respective row of contacts, whereby it is advantageous that the guiding grooves of a first row of contacts and of the two row of contacts are longer than the guiding grooves of the other second row of contacts.

In a descriptive embodiment of the second aspect, the contacts on the first row of contacts are disposed at a larger distance from an inserting area for a coil than the contacts on the second row of contacts.

In a more advantageous embodiment herein, at least the guiding grooves of the first row of contacts have a constant or increasing depth at a growing distance from the inserting area.

In another descriptive embodiment of the second aspect, each guiding groove in the surface of at least the first row of contacts is formed by two fins that protrude from the surface. In some descriptive examples herein, a height and/or a width of each fin is larger or equal to a depth and/or width of each guiding groove.

In another descriptive embodiment of the second aspect, respectively one insulation groove is formed between two guiding grooves of at least the first row of contacts.

In another descriptive embodiment of the second aspect, the guiding grooves of at least the first row of contacts are arranged at a distance from each other through fins that are formed in the surface.

In another descriptive embodiment of the second aspect, the guiding grooves interfuse the surface of the first row of contacts completely along one direction in parallel to the surface.

In another descriptive embodiment of the second aspect, ends of the contacts for the connection with connectors of the coil on the first row of contacts protrude from the first row of contacts in a contact plane and the contact plane is disposed in an offset position by an offset in parallel to the surface.

BRIEF DESCRIPTION OF THE DRAWINGS

Further advantages and features of the present invention may be taken from the following description together with the enclosed Figures in which FIG. 1*a* to 1*c* schematically show a coil body according to a first aspect of the invention from different perspectives.

DETAILED DESCRIPTION OF THE INVENTION

Figure 1A:
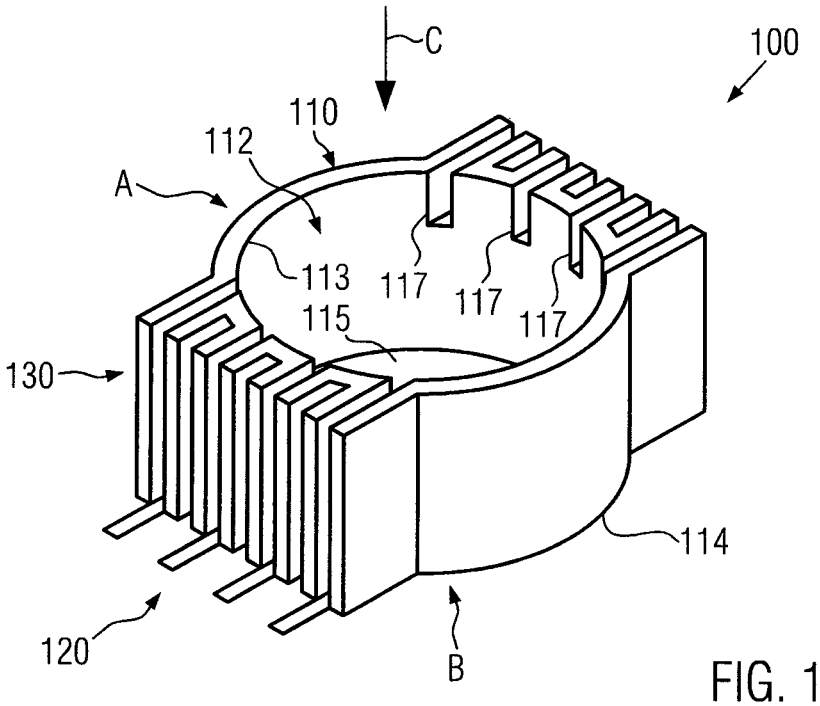

FIG. 1*a* schematically displays a perspective view of a coil body that has a hollow housing body 110. The housing body 110 is formed preferably for the intake of a torus-shaped coil (coil is not shown). The coil may comprise a magnetic core (not shown) and at least one winding (not shown). Alternatively, the coil may be provided without a magnetic core.

According to the illustration in FIG. 1*a*, the housing body 110 has an opening 112 on a first side A of the housing body 110 such that a coil (not shown) may be inserted in the housing body 110 along a direction that is designated with the reference sign "C" in FIG. 1*a*. The housing body 110 is preferably closed on a second side B that is opposite to the first side A. This means that a base 115 is provided in the housing body, which base serves as a support surface for a coil (not shown) that has been inserted in the housing body. A housing wall 114 extends between the first side A and the second side B so that a coil that has been inserted in the housing body 110 is enclosed by the base 115 and the housing wall 114.

Guiding grooves 130 that extend in parallel to the direction C are formed in the housing wall 114 between the first side A and the second side B. The guiding grooves 130 extend preferably completely along the housing wall between the first side A and the second side B of the housing body 110. Each of the guiding grooves 130 is formed preferably for complete intake of a connection wire, i.e. a depth from each guiding groove 130 is greater than or equal to a diameter of the connection wire (not shown).

As shown in FIG. 1*a*, a plurality of contacts 120 is disposed on the second side B. The plurality of contacts is used for electric and mechanical fixing of the coil body 100 on a conductor plate (not shown). Therefore, at least one contact 120 for an electric and/or mechanical connection between the conductor plate (not shown) and the coil body 100 may be provided. According to an embodiment, the contacts 120 may be formed in an L-shaped way and protrude from the housing body 110 along the direction C towards the bottom. An uncovered end of the at least one contact 120 is therefore preferably bent along a direction that is perpendicular to the direction C. In this way, a SMD component is provided. Alternatively, the uncovered ends of the contacts 120 essentially extend along a direction that is parallel to the direction C so that the contacts 120 are formed as a throughput contact.

Figure 1B:
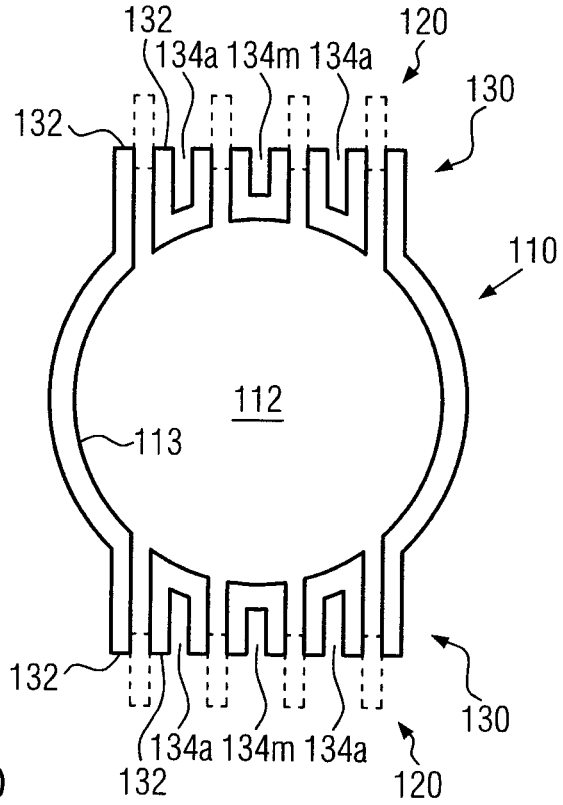

A top view of the housing body 110 (along the direction C in FIG. 1*a*) is displayed with reference to FIG. 1*b*. The contacts 120 are indicated by the dotted line in the displayed top view. As may be seen from the illustration in FIGS. 1*a* and 1*b*, each guiding groove 130 is formed by two fins 132 that are disposed at a distance from each other and that are situated along the direction C on the housing wall 114 and that protrude from the housing wall 114 in a perpendicular direction to direction C, in particular in a vertically intersecting way to the sheath surface of the housing wall 114.

In some descriptive embodiments, an insulation groove 134 is formed between respectively two adjacent guiding grooves 130. The insulation grooves 134 and the guiding grooves 130 are consequently disposed alternatingly along the housing wall 114 (from a circumferential perspective). As shown by the top view in FIG. 1*b*, a depth of each insulation groove 134 may vary along the circumferential direction around the opening. For example, external insulation grooves 134*a* may have a greater depth than internal insulation grooves 134, e.g. the central insulation groove 134*m* in FIG. 1*b*. If connection wires on which there is a greater potential difference are laid in the external guiding grooves, a comparably longer insulation path will be provided by means of the insulation grooves that are formed between these guiding grooves with a comparably greater depth than it is the case for example for more central guiding grooves. According to a descriptive example herein, a depth of the insulation groove 134 may depend on an azimuthal position of the insulation groove 134 along a circumferential direction of the opening 112 as displayed in FIG. 1*b*.

Figure 1C:
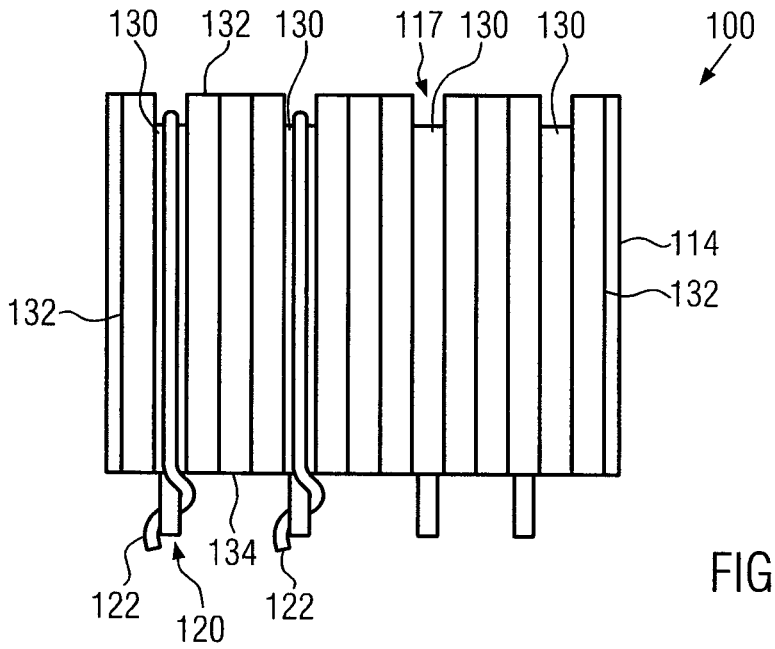

Reference is made to FIG. 1*a* and FIG. 1*c*. In this, FIG. 1*c* shows a planar side view of the coil body 100 from FIG. 1*a* that is perpendicular to the direction C. According to the illustration, a throughput may be further provided between a guiding groove 134 and the inside of the housing body 110 by means of a slit 117 that is formed on the edge 113 of the opening 112. In some descriptive examples herein, each of the slits 117 is formed on the edge 113 of the opening 112 with a depth that is essentially greater than a diameter of a connection wire 122 that is connected to at least one winding of a coil that is absorbed into the housing body 114 in the illustration of FIG. 1*c*. An advantageous dielectric strength is thereby provided during guiding of the connection wire from the inside of the housing body 110 towards the outside of the housing body 110.

According to some embodiments that are not shown, the coil body 100 displayed in FIG. 1*a* may comprise, to the extent to which the coil body is to be installed on a conductor plate (not shown) not exclusively via the contacts 120, further fixing devices for fixing and/or means of orientation for orientation of the coil body 100 on a conductor plate, for example snap-fits, clips, positioning pins etc. that protrude from a bottom side of the coil body 100 along the direction C. Further, a lid (not shown) may be provided to cover the opening 112 of the housing body 110.

Figure 2A:
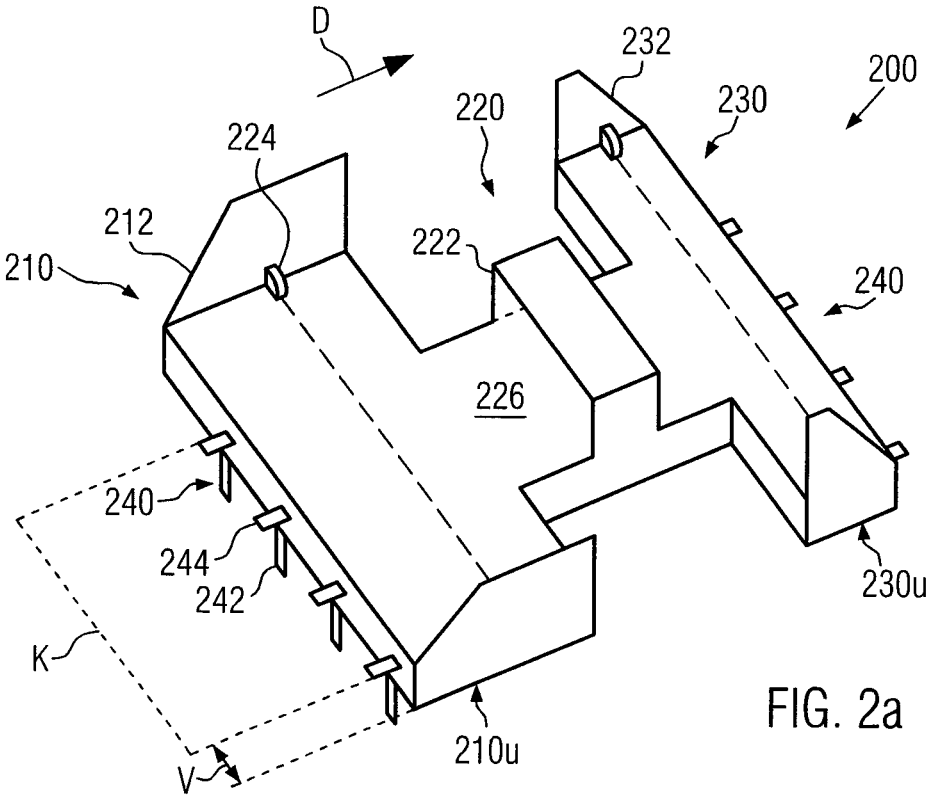
FIG. 2*a* to 2*c* schematically show a coil body according to a second aspect of the invention from different perspectives.

Alternative embodiments of the present invention are described with reference to the FIGS. 2*a* and 2*b*. FIG. 2*a* shows a coil body 200 that is formed for an inductive component preferably with a double E- or E-I-core configuration. The coil body 200 has a first row of contacts 210, a core guiding area 220 and a second row of contacts 230. The first row of contacts 210, the core guiding area 220 and the second row of contacts 230 may be formed at least partially in an integral or modular way, i.e. the first row of contacts 210 and/or the core guiding area 220 and/or the second row of contacts 230 may be attached (optionally removably) to each other or be formed integrally as one element.

In some descriptive embodiments, the core guiding area 220 is designed for absorption of at least one leg of an E- and/or I-core. For this purpose, the core guiding area 220 has a core support area 232, for example the shown support piece or snap-fits (not shown) etc.

According to the illustration in FIG. 2*a*, the contacts 240 are arranged on the first row of contacts 210 and on the second row of contacts 230. As illustrated, the contacts 240 may be formed as L-shaped contact pins whose uncovered ends 244, 242 protrude from the row of contacts 210, 230. Alternatively, the contacts 240 may be formed as U-shaped contact pins whereby an SMD component is provided.

Fixing of a magnetic core on the coil body 200 may for example occur in that the core (not shown), which is guided by guiding areas 212 on the first row of contacts 210 and the core support area 232 on the second row of contacts 230, is inserted in the coil body 200 along an inserting direction D and supported by holding burls 224 in an intake area 226 of the coil body 200 through interaction with the support structure 222. Connection wires for windings (not shown) are led to the uncovered ends 244 of the contacts 240 on the bottom side of the coil body 200 and connected to such ends. A connection of the coil body 200 with a(n) (electric and/or mechanical) conductor board that is not shown is established via the uncovered ends 242 of the contacts 240.

Figure 2B:
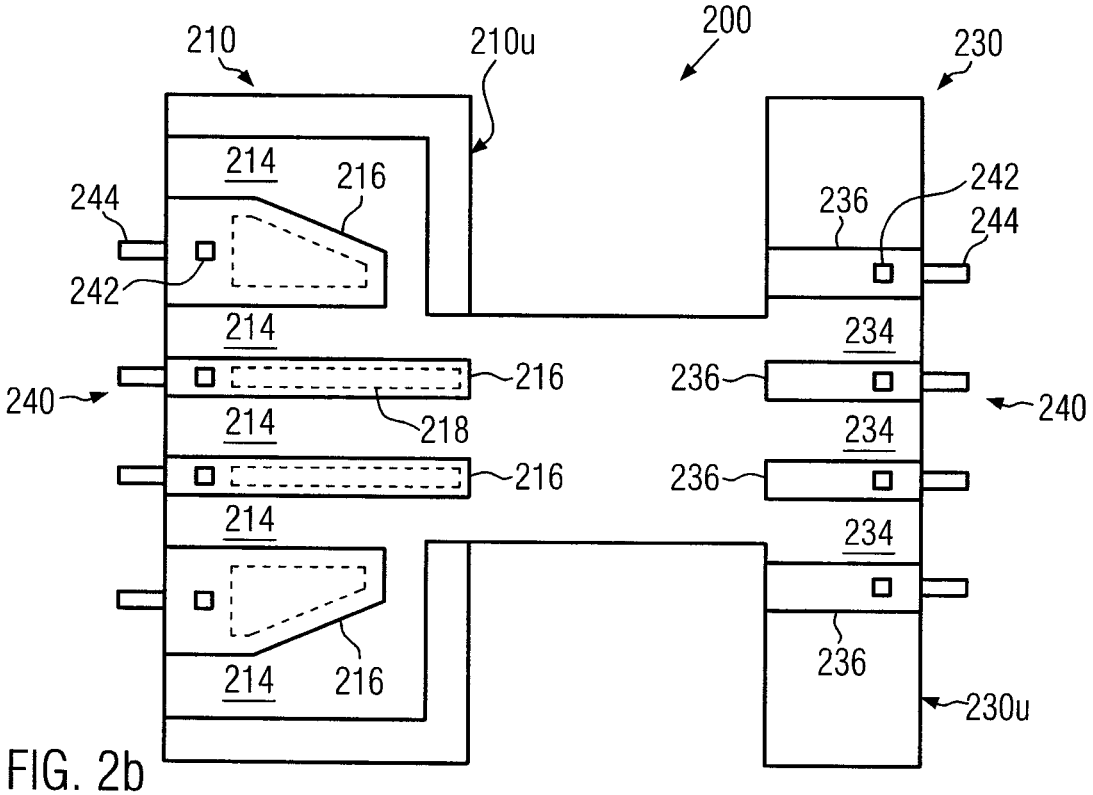

FIG. 2*b* shows a view of the bottom side of the coil body 200. Guiding grooves 214 are formed on a surface 210U of the bottom side of the row of contacts 210 displayed in FIG. 2*a*. Likewise, guiding grooves 234 are formed on the bottom side in a surface 230U of the second row of contacts 230. The guiding grooves 214 and/or 234 are used for intake and guiding of a connection wire (not shown) of a winding (not shown) that is to be installed on top of the coil body 200. A connection wire (not shown) is thereby led through a guiding groove 214 to the uncovered end 244 of a contact 240 and connected electrically to such contact, for example by means of winding around the uncovered end 244 and fixing on the uncovered end 244. The guiding grooves 214 are separated from each other through fins 216 that are formed in the surface 210U of the row of contacts 210. Accordingly, the guiding grooves 234 are determined in the bottom-side surface of the second row of contacts 230 by fins 236.

In some descriptive embodiments, an insulation groove 218 is formed in at least one fin 216. Therefore, the insulation groove 218 contributes to the prolongation of the creepage path between two neighboring guiding groves 214 in addition to the fin 216. According to descriptive examples, a depth of the at least one insulation groove 218 is smaller than or equal to a depth of at least one of the surrounding guiding grooves 214. In addition, an optional guiding groove may further be provided at least in one of the fins 236 of the second row of contacts 230.

In some descriptive embodiments of the present invention, a height and/or width of each fin is greater than or equal to a depth and/or width of each guiding groove.

A further improvement of the dielectric strength of the coil body 200 may for example be achieved in that the guiding grooves 214 of the first row of contacts 210 are longer than the guiding grooves 234 of the second row of contacts 230. According to some descriptive embodiments, this is achieved in that the contacts 240 on the first row of contacts 210 are arranged under a greater distance to the intake area 226 than the contacts 240 on the second row of contacts 230. For example the contacts 240 on the first row of contacts 210 may be provided as high voltage-conducting contacts during use of the coil body 200.

Reference is made to FIG. 2*a*. The uncovered ends 244 of the contacts 240 are arranged, at least on the first row of contacts 210, in a plane K according to some descriptive embodiments. The plane K is thereby spaced from the bottom-side surface 210U of the first row of contacts 210 by an offset V. With this, an insulation path between the connection wires and the uncovered ends of neighboring contacts may be set in an advantageous way.

Figure 2C:
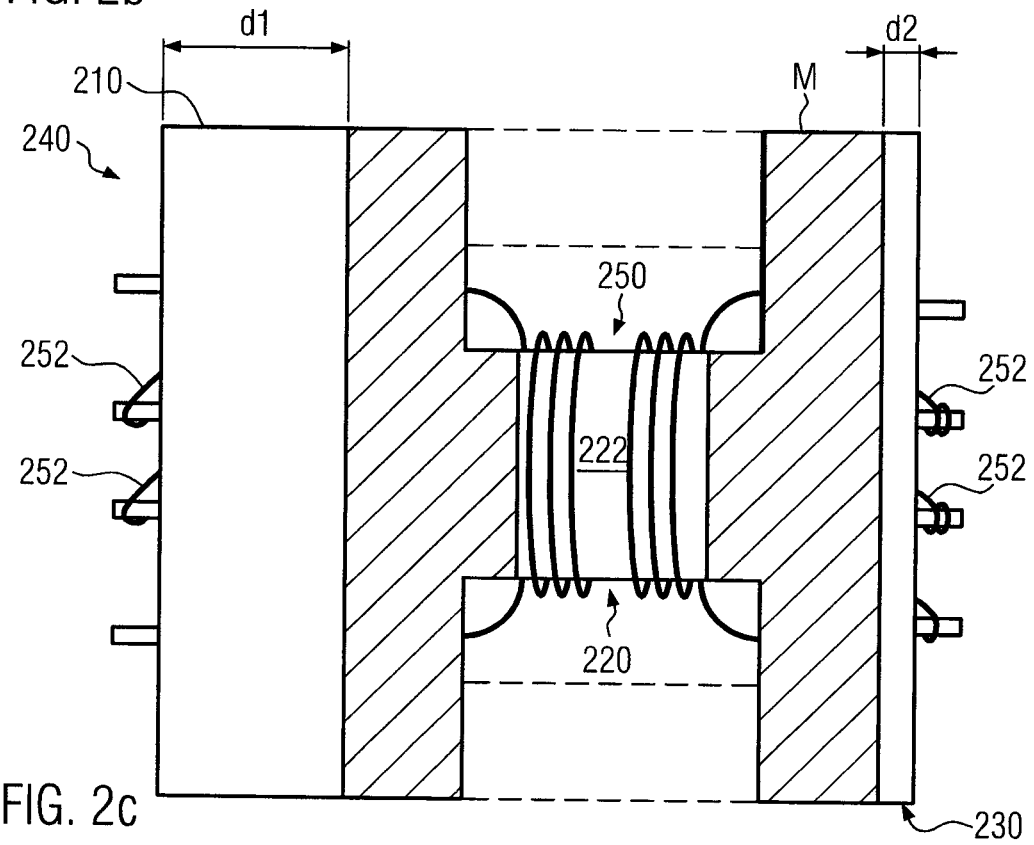

FIG. 2*c* shows a planar top view of the coil body 200 from FIG. 2*a*, whereby a magnetic core M and a winding 250 are installed on such coil body. The winding 250 is arranged for example on top of the support structure 222 that may for example be used as a winding chamber. Uncovered ends 252 of the winding 250 may be connected electrically to uncovered ends 244 of the contacts 240.

In some descriptive examples, the magnetic core M may be achieved by three I-cores or an EII-core configuration. Alternatively, the core is formed according to a double-E configuration (cf. dotted lines) or an EI-core configuration.

A distance d1 between the core M and/or the winding 250 from the contacts 240 on the first row of contacts 210 is greater than a distance d2 between the contacts 240 on the second row of contacts 230 and the core M and/or the winding 250. This provides a prolonged creepage path on the first row of contacts 210. According to a special example, the following applies: $d1 \geq 1.5*d2$ or $d1 \geq 2*d2$ or $d1 \geq 3*d2$.

What is claimed is:

1. A coil body that has on a first side an opening for inserting a coil in a housing body along an inserting direction and a housing wall that extends between the first side of the housing body and an opposite second side, electric contacts and a plurality of guiding grooves that are situated along the housing wall and that are each formed for guiding a connection wire in order to connect a coil that has been inserted through the housing body to the contacts, whereby the contacts are disposed on the opposite second side on the housing body, wherein the coil body further has slits that are formed on an edge of the opening and that are disposed on the opening in a circumferential direction so that a throughput into the housing body and/or out of the housing body is provided for each guiding groove, and wherein the guiding grooves are formed by fins that protrude from the housing wall and that extend in parallel along the inserting direction, respectively two fins forming a guiding groove and fins of respectively one guiding groove being all spaced from the fins of the other guiding grooves so that respectively one insulation groove is formed between two guiding grooves.

2. The coil body according to claim 1, wherein at least one guiding groove extends completely along the housing wall.

3. The coil body according to claim 1, wherein the housing body is configured to receive a torus-shaped coil.

4. The coil body according to claim 1, wherein the insulation grooves have different depths.

5. A coil body for supporting a coil comprising:

a housing body having a housing wall with a length extending between a base and an opposing edge;

a plurality of fins extending along and from the housing wall forming alternating insulation grooves and guiding grooves having different depths from the housing wall, wherein the alternating insulation grooves have a closed surface extending along the length of the housing wall from the base to the opposing edge; and a slot placed through the housing wall in said housing body adjacent a respective one of the guiding grooves wherein said slot extends from the opposing edge of the housing wall towards the base and a connection wire is capable of passing through said slot, whereby creepage paths are capable of being increased and connection wires having higher potential may be placed in the guiding grooves.

6. The coil body for supporting a coil as in claim 5 further comprising:

a coil having connecting wires placed within the coil body, wherein one each of the connecting wires of said coil pass through a respective one of said slot placed through the housing wall and into a respective one of the guiding groves and none of the connecting wires of said coil are placed in the insulating grooves.

* * * * *